US010939206B2

(12) United States Patent
Shah et al.

(10) Patent No.: US 10,939,206 B2
(45) Date of Patent: Mar. 2, 2021

(54) AUDIO ACCESSORY STORING A POLICY FOR GENERATING AUDIO OUTPUT

(71) Applicant: Microsoft Technology Licensing, LLC, Redmond, WA (US)

(72) Inventors: Chirag Deepakkumar Shah, San Jose, CA (US); Sergei Ivanov, Issaquah, WA (US); Mauricio Sanchez, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/435,385

(22) Filed: Jun. 7, 2019

(65) Prior Publication Data

US 2020/0389733 A1 Dec. 10, 2020

(51) Int. Cl.

| | |
|---|---|
| ***H04R 5/033*** | (2006.01) |
| ***H04R 5/04*** | (2006.01) |
| ***H04R 3/04*** | (2006.01) |
| ***H04R 1/10*** | (2006.01) |

(52) U.S. Cl.

CPC ..... *H04R 5/033* (2013.01); *H04R 1/1041* (2013.01); *H04R 3/04* (2013.01); *H04R 5/04* (2013.01); *H04R 2430/01* (2013.01)

(58) Field of Classification Search

None

See application file for complete search history.

(56) References Cited

U.S. PATENT DOCUMENTS

| | | | | |
|---|---|---|---|---|
| 7,437,290 | B2 | 10/2008 | Danieli | |
| 8,768,494 | B1 | 7/2014 | Stroud et al. | |
| 8,831,953 | B2 | 9/2014 | Vanjani | |
| 9,596,568 | B1 | 3/2017 | Keller | |
| 10,114,351 | B2 | 10/2018 | Fadell et al. | |
| 2005/0268317 | A1 | 12/2005 | Cormack et al. | |
| 2014/0126736 | A1* | 5/2014 | Gauger, Jr. ..... | G10K 11/17881 381/71.6 |
| 2015/0117662 | A1* | 4/2015 | Kulavik ..... | H04R 1/1041 381/74 |
| 2015/0189572 | A1 | 7/2015 | Mchenry et al. | |
| 2015/0347768 | A1 | 12/2015 | Martin et al. | |

OTHER PUBLICATIONS

"Manage use of your speaker or Smart Display", Retrieved from: https://support.google.com/assistant/answer/9175081?hl=en, Retrieved Date: Apr. 18, 2019, 4 Pages.

Freeman, Kate, "Parents Can Set Volume Limits with These Kid-Sized Headphones", Retrieved from: https://mashable.com/2012/12/11/headphones-for-kids-nabi-notes/, Dec. 12, 2012, 2 Pages.

Martin, Taylor, "How to use Alexa's parental controls", Retrieved from: https://www.cnet.com/how-to/how-to-mable-alexa-parental-controls/, Sep. 4, 2018, 7 Pages.

"International Search Report and Written Opinion Issued in PCT Application No. PCT/US20/030170", dated Jul. 20, 2020, 12 Pages.

* cited by examiner

*Primary Examiner* — Kenny H Truong

(74) *Attorney, Agent, or Firm* — Wade IP Law LLC

(57) ABSTRACT

An audio accessory having a locally stored and executed policy. The policy includes a rule related to audio output generation. The audio accessory can be a peripheral audio accessory, and the policy can be stored on the peripheral audio accessory so that the policy can be applied to communications from any source.

20 Claims, 4 Drawing Sheets

AUDIO ACCESSORY STORING A POLICY FOR GENERATING AUDIO OUTPUT

BACKGROUND

Audio accessories, such as headphone devices and portable speakers, have become ubiquitous in modern society. An audio accessory typically is connected to a device that provides an audio signal, such as music, so that a user of the audio accessory is able to listen to the audio signal. The device typically is a computer or a dedicated audio device. Audio accessories often are constructed to be portable and, as a result, they can be indiscriminately connected to any suitable device, such as a cellular phone, personal digital assistant, desktop computer, tablet computer, stereo system, or MP3 player. The indiscriminate connectivity of the audio accessories may expose the user to audio signals presenting undesirable attributes, such as undesirable content, and the audio accessories to undesirable commands or executables, such as malware.

SUMMARY

Various approaches are described herein for, among other things, providing an audio accessory configured to store and enforce a policy, such as by enforcing rule(s) of the policy, to generate an audio output signal. An audio accessory is an audio-producing apparatus that includes a housing that contains, or supports, a sound production means, such as a transducer. The audio accessory can be a self-contained audio accessory or a peripheral audio accessory. A self-contained audio accessory is an audio accessory that is configured to receive content, to generate an audio signal based at least in part on the content, and to convert the audio signal into an audible signal. A peripheral audio accessory is an audio accessory that is capable of processing audio input signals that are received from any of a variety of source devices, and that requires a source device because the peripheral audio accessory is dependent on the source device for providing the audio input signal to the peripheral audio accessory. The audio input signal supplied to the peripheral audio accessory can be based on content that is accessible to the source device but not the peripheral audio accessory. The peripheral audio accessory may not be configured to access content directly or to generate an audio signal directly from content. The peripheral audio accessory may store and enforce the policy so that the peripheral audio accessory can be utilized with any separate, external device while protecting the user and/or the peripheral audio accessory by consistently enforcing the policy. The policy can include an audio rule that is used to regulate an audio output signal and/or an administrative rule that is used to control software and/or hardware of the audio accessory.

An example peripheral audio accessory comprises a receiver, a memory, and processor(s). The receiver is configured to receive an audio input signal from a separate source device. The audio input signal is based at least in part on content processed by the separate source device. The memory is configured to store a policy that includes rule(s). The processor(s) are coupled to the memory and configured to monitor a received audio input signal to determine whether the received audio input signal complies with the rule(s) of the policy, enforce the rule(s) of the policy, and generate an audio output signal based at least in part on the enforcement of the rule(s). The rule(s) define a volume control, a feature ON/OFF control, and/or a content filter.

A second example peripheral audio accessory comprises a receiver, a memory, and processor(s). The receiver is configured to receive a communication from a separate source device and an audio input signal. The memory is configured to store a policy comprising administrative rule(s) and audio rule(s). The processor(s) are coupled to the memory and configured to monitor a received communication to determine whether the received communication complies with the administrative rule(s) of the policy, enforce the administrative rule(s) of the policy and the audio rule(s) of the policy, and generate an audio output signal based at least in part on the enforcement of the audio rule(s).

A third example peripheral audio accessory comprises a receiver, a memory, processor(s), and a speaker. The receiver is configured to receive an audio input signal from a separate source device. The audio input signal is based at least in part on content processed by the separate source device. The memory is configured to store a policy that includes rule(s). The processor(s) are coupled to the memory and configured to monitor a received audio input signal to determine whether the received audio input signal complies with the rule(s) of the policy, enforce the rule(s) of the policy, and generate an audio output signal. The rule(s) define a volume control and/or a content filter. The speaker is configured to generate an audible signal based at least in part on the audio output signal.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Moreover, it is noted that the invention is not limited to the specific embodiments described in the Detailed Description and/or other sections of this document. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles involved and to enable a person skilled in the relevant art(s) to make and use the disclosed technologies.

Figure 1:
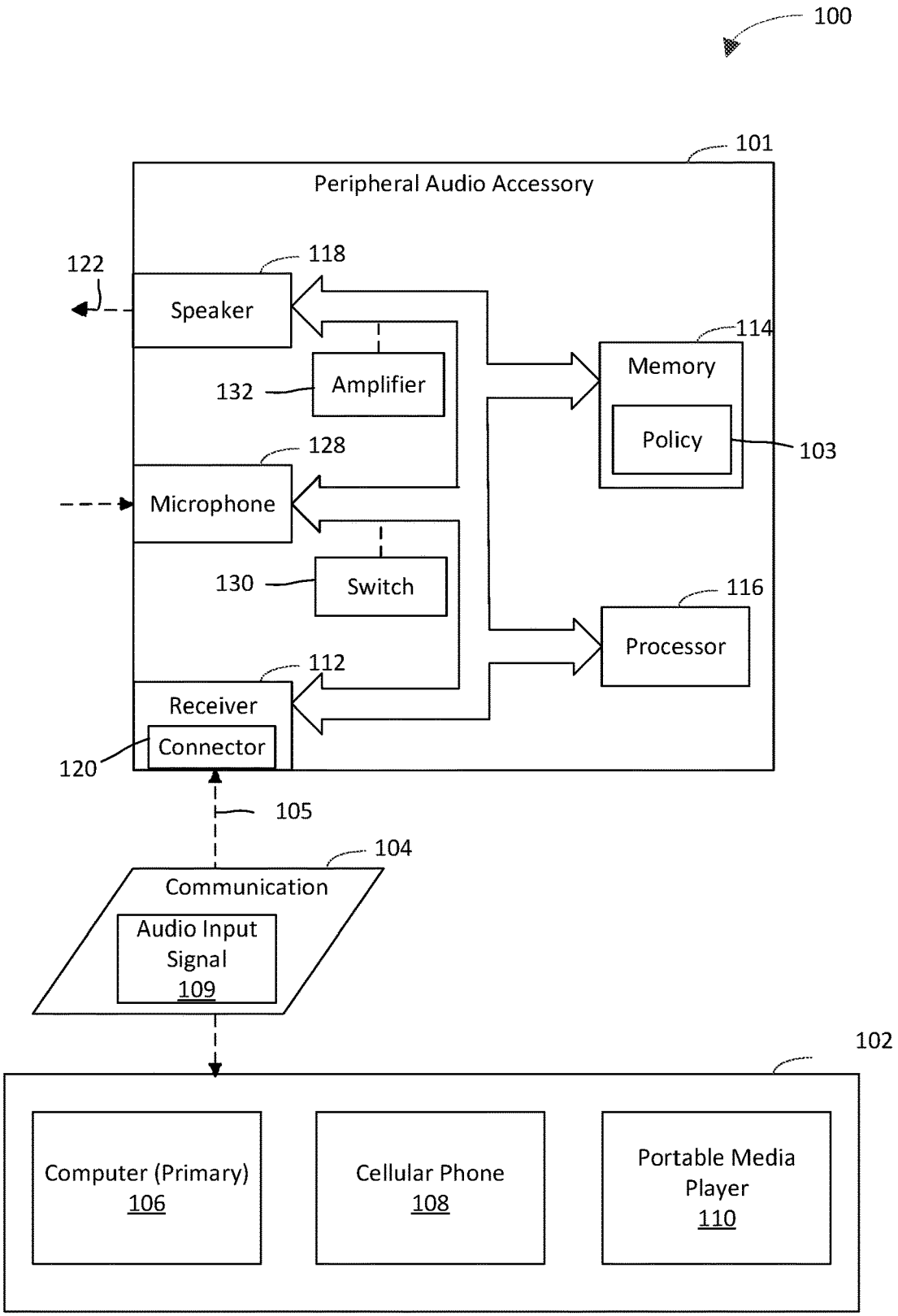
FIG. 1 is a block diagram of an accessory-based policy system in accordance with an embodiment.

The features and advantages of the disclosed technologies will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

I. Introduction

The following detailed description refers to the accompanying drawings that illustrate example embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the relevant art(s) to implement such feature, structure, or characteristic in connection with other embodiments whether or not explicitly described.

II. Example Embodiments

Example embodiments described herein are capable of providing an audio accessory configured to store a policy and enforce the policy, such as by enforcing rule(s) of the policy, to generate an audio output signal. An audio accessory is an audio-producing apparatus that includes a housing that contains, or supports, a sound production means, such as a transducer. The audio accessory can be a self-contained audio accessory or a peripheral audio accessory. A self-contained audio accessory is an audio accessory that is configured to receive content, to generate an audio signal based at least in part from the content, and to convert the audio signal into an audible signal. A peripheral audio accessory is an audio accessory that is capable of processing audio input signals that are received from any of a variety of source devices, and that requires a source device because the peripheral audio accessory is dependent on the source device for providing the audio input signal to the peripheral audio accessory. The audio input signal supplied to the peripheral audio accessory can be based on content that is accessible to the source device but not the peripheral audio accessory, and the peripheral audio accessory is not configured to access content directly or to generate an audio signal directly from content. For instance, the peripheral audio accessory may be coupled (e.g., wirelessly coupled) to a separate source device and enforce the policy against an audio input signal received from the separate source device. The peripheral audio accessory may generate the audio output signal to comply with the policy regardless of the source of the audio input signal. For instance, the peripheral audio accessory may store and enforce the policy so that the peripheral audio accessory can be utilized with any separate, external source device while protecting the user and/or the peripheral audio accessory by consistently enforcing the policy. The policy can comprise an audio rule that is used to regulate the audio output signal and/or an administrative rule that is used to control software and/or hardware of the audio accessory.

FIG. 1 is a block diagram of an example accessory-based policy system 100 in accordance with an embodiment. Generally speaking, the accessory-based policy system 100 operates to enable a peripheral audio accessory 101 to store a policy 103 and to enforce rule(s) of the policy 103 against audio input signals that are received from any of a variety of source devices.

The accessory-based policy system 100 includes the peripheral audio accessory 101 and a separate source device 102. The peripheral audio accessory 101 is dependent on the separate source device 102 to provide an audio input signal 109, rather than being configured to harvest media content and to convert the content into an audio signal. For example, the peripheral audio accessory 101 is configured to receive a communication 104 from the separate source device 102. The communication 104 may include the audio input signal 109. The peripheral audio accessory 101 may be configured to apply a local policy to any communication 104 received by the peripheral audio accessory 101.

The peripheral audio accessory 101 is a processing system that is capable of processing audio input signals (e.g., audio input signal 109) that are received from any of a variety of source devices, such as the separate source device 102. An example of a processing system is a system that includes at least one processor that is capable of manipulating data in accordance with a set of instructions. The peripheral audio accessory 101 may be configured to connect to any of a variety of source devices based on the user's preference.

The peripheral audio accessory 101 comprises a receiver 112, a memory 114, a processor 116, and a transducer such as a speaker 118. The receiver 112 is configured to carry out communication 104 between the peripheral audio accessory 101 and the separate source device 102 over a communication link 105. The communication link 105 may be a wired communication link or a wireless communication link. The receiver 112 includes a signal input interface that can be configured to receive a digital signal and/or an analog signal. The interface can include a wired connector 120 in the form of a connector port, such as for a 3.5 mm plug, cinch connectors (e.g., RCA connectors), a universal serial bus (USB) connector, or any other wired data transmission connector. For instance, the connector port can include a cable with a male connector for plugging into a female connector of a source device, such as the separate source device 102. As an alternative, or in addition, to a wired connection, the interface can include a wireless connection. For instance, the wireless communication link may be established in accordance with certain RF-based (e.g., short-range) communication technologies such as Bluetooth® (developed by the Bluetooth Special Interest Group), technologies such as ZigBee® (developed by the Zigbee Alliance) that are based on the IEEE 802.15.4 standard for wireless personal area networks, or technologies that are based on the IEEE 802.11 standard for wireless local area networks. These examples are not intended to be limiting, and the wireless communication link may be established using any of a variety of other standard or propriety communication protocols. In an example embodiment, the receiver 112 can be configured as an input/output device (e.g., a transceiver) so that the receiver 112 is also configured to transmit an output signal via the communication link 105 to the separate source device 102.

The memory 114 is configured to store the policy 103 locally in the peripheral audio accessory 101. The policy 103 includes at least one rule that is enforced on any communication 104 received by the peripheral audio accessory 101. The rule can be an audio rule or an administrative rule. The memory 114 can comprise any type of memory device, such as random access memory (RAM), a hard drive, memory cards, memory sticks, or combinations thereof.

The processor 116 is coupled to the memory 114. The processor 116 monitors the communication 104 that is received from the separate source device 102 and enforces the policy 103 that is stored in the memory 114. In an example embodiment, the processor 116 is configured to monitor an audio input signal 109 included in the communication 104 to determine whether the audio input signal 109 complies with an audio rule of the policy 103. In accordance with this embodiment, the processor 116 is further configured to enforce the audio rule (e.g., against the audio input signal 109) and to generate an audio output signal based on the enforcement of the audio rule. In another example embodiment, the processor 116 is configured to monitor a command included in the communication 104 to determine whether the command complies with an administrative rule. In accordance with this embodiment, the processor 116 is further configured to enforce the administrative rule. The processor 116 can be a digital signal processor (DSP) incorporated into the peripheral audio accessory 101, though the scope of the example embodiments is not limited in this respect. It will be recognized that the processor 116 can include a single processor or multiple processors.

The speaker 118 is configured to generate an audible signal 122 based at least in part on the audio output signal generated by the processor 116. The speaker 118 is a transducer that converts the audio output signal from the processor 116 into sound. The speaker 118 can be incorporated into any device construction, such as a headphone device 400 (shown in FIG. 4) or a portable speaker 500 (shown in FIG. 5). The speaker 118 can be configured as a digital or analog transducer.

The peripheral audio accessory 101 can further comprise a microphone 128. Similar to the speaker 118, the microphone 128 is also a transducer, but the microphone 128 is configured to convert sound received by the microphone 128 into an electrical signal. In an example embodiment, the policy 103 can include a rule that defines a feature ON/OFF control that toggles the operation of the microphone 128 between an on state and an off state so that the microphone 128 can be selectively enabled (in the on state) or disabled (in the off state). The operation of the microphone 128 can be controlled through software such as by preventing the signal generated by the microphone 128 from being included in the output audio signal generated by the processor 116. As an alternative, the operation of the microphone 128 can be controlled through hardware, such as by operating a switch 130 using a command provided in the communication 104. In an example embodiment, the switch 130 is configured as a fuse, such as a silicon fuse, or an antifuse.

The peripheral audio accessory 101 can further comprise an amplifier 132. The amplifier 132 can be coupled to the speaker 118 and configured to amplify the audio output signal generated by the processor 116. The impedance of the amplifier 132 can be altered to control the volume of the audible signal 122 generated by the speaker 118. For example, the policy 103 may include a rule that specifies a volume threshold, and the processor 116 may control the impedance of the amplifier 132 to maintain the output volume of the audible signal 122 generated by the speaker 118 to be less than or equal to the volume threshold.

The separate source device 102 is a processing system that is capable of generating the audio input signal 109 to be processed by the peripheral audio accessory 101. For instance, the separate source device 104 may be configured to execute a computer program that generates the audio input signal 109 for consumption by a user via the peripheral audio accessory 101 in response to receiving a request from the user. The separate source device 102 is separate from the peripheral audio accessory 101 and supplies the audio input signal 109 to the peripheral audio accessory 101. For example, the separate source device 102 can be configured as a computing device, such as a computer 106, a cellular phone 108, or a portable media player 110. Examples of a computer that may be used as the separate source device 102 include a desktop computer, a laptop computer, a smart phone, a personal digital assistant, and a tablet computer. Examples of a portable media player that may be used as the separate source device 102 include a MP3 player, a CD player, and a voice recorder.

In an example embodiment, the separate source device 102 is the computer 106, and the computer 106 can be designated as a primary device (a.k.a. control device). The primary device can be configured to have permission to perform administrative operations with regard to the peripheral audio accessory 101. The administrative operations may include loading and/or changing the policy 103, software, and/or firmware stored in the peripheral audio accessory 101. For example, a parent may use the computer 106 to perform such administrative operations on the peripheral audio accessory 101 that is used by a child of the parent. The computer 106 can be used to set and/or alter the policy 103 stored in the peripheral audio accessory 101, and the policy 103 can include a rule that is applied to an audio input signal portion of a communication 104 sent by any separate source device 102 to filter content, to set volume limits, and/or to set usage time limits. Because the policy 103 is stored, and enforced, locally by the peripheral audio accessory 101, the policy 103 can be applied to any communication 104 that is received by the peripheral audio accessory 101 regardless of the separate source device 102 providing the communication 104. In another example, the policy 103 can include a rule used by the peripheral audio accessory 101 for security, such as by specifying an authentication protocol that is to be applied to the communication 104 that includes a command to make a change to the peripheral audio accessory 101.

Figure 2:
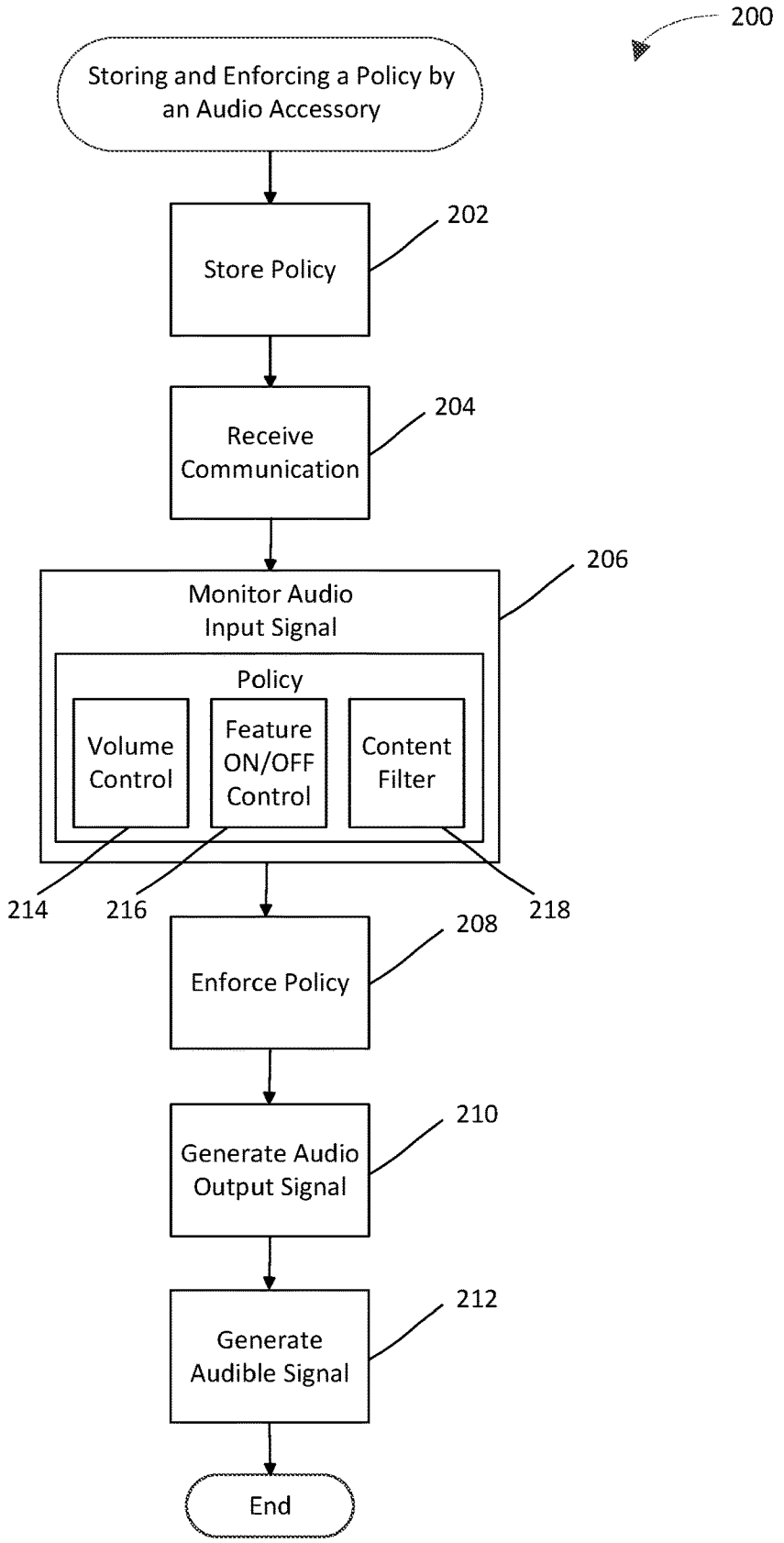
FIGS. 2 and 3 depict flowcharts of example methods for storing and enforcing a policy by an audio accessory in accordance with embodiments.
Figure 3:
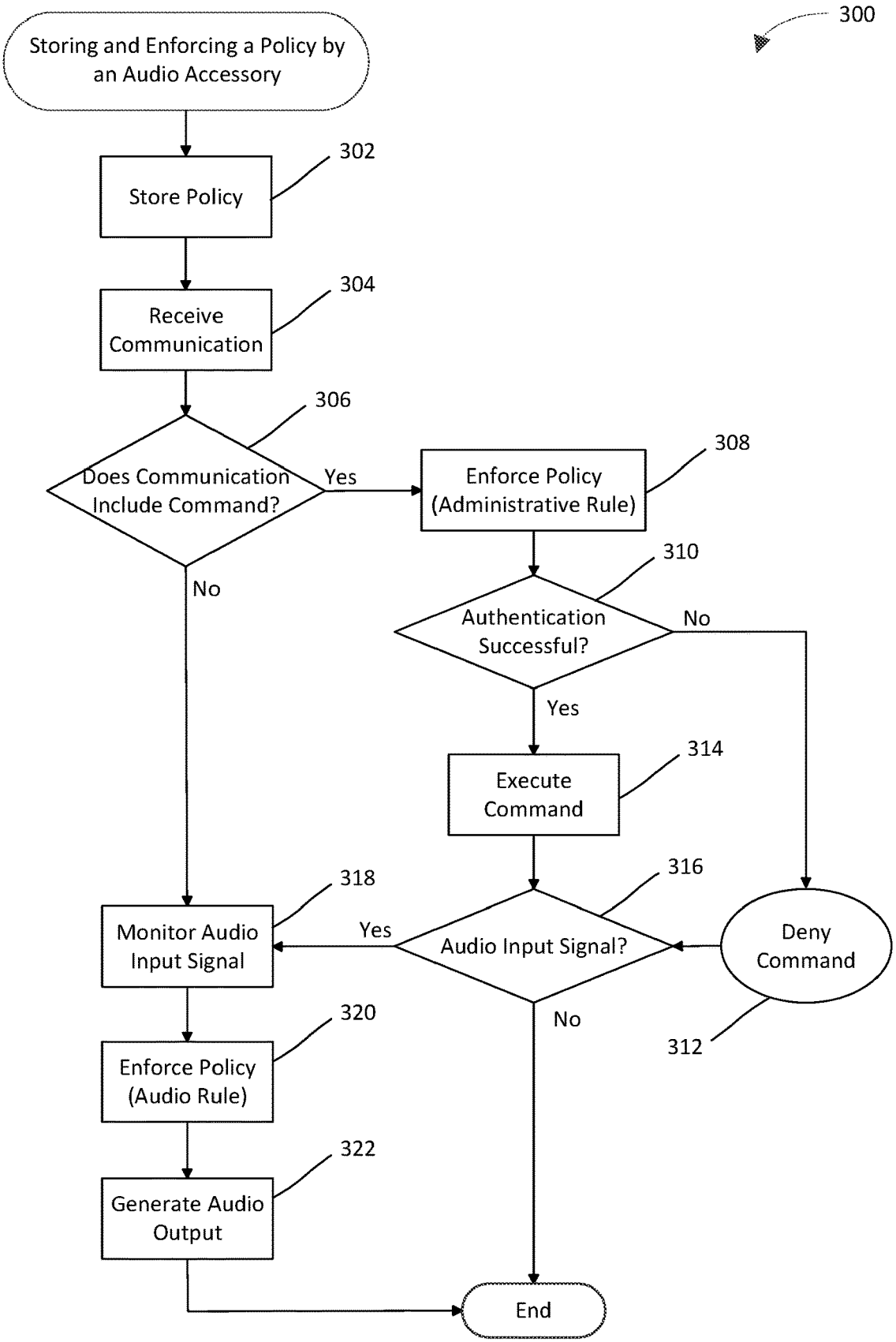

FIGS. 2 and 3 depict flowcharts 200 and 300 of example methods for storing and enforcing a policy by an audio accessory in accordance with embodiments. Flowcharts 200 and 300 can be performed using (e.g., by) the peripheral audio accessory 101 of FIG. 1, for example. Further structural and operational embodiments will be apparent to persons skilled in the relevant art(s) based on the discussion regarding the flowcharts 200 and 300.

As shown in FIG. 2, the method of flowchart 200 begins at step 202. In step 202, a policy is stored in a peripheral audio accessory. In an example implementation, the memory 114 of the peripheral audio accessory 101 receives and stores the policy 103.

At step 204, a communication is received by the peripheral audio accessory. In an example implementation, the receiver 112 of the peripheral audio accessory 101 receives the communication 104. For example, the communication 104 may include an audio input signal 109.

At step 206, an audio input signal is monitored by the peripheral audio accessory. In an example implementation, the processor 116 of the peripheral audio accessory 101 monitors the audio input signal 109. For example, the processor 116 of the peripheral audio accessory 101 may monitor the audio input signal 109 to determine whether the audio input signal 109 complies with the rule(s) of the policy 103. In accordance with this example, the rule(s) can be directed to an audio attribute and can define a volume control 214, a feature ON/OFF control 216, or a content filter 218.

At step 208, the policy is enforced by the peripheral audio accessory. In an example implementation, the processor 116 enforces the policy 103 that is stored locally in the memory 114 of the peripheral audio accessory 101. For example, the processor 116 may enforce the policy 103 by applying the rule(s) of the policy 103 to the audio input signal 109.

At step 210, an audio output signal is generated by the peripheral audio accessory. In an example implementation, the processor 116 generates an audio output signal from the audio input signal 109. For example, the processor 116 may enforce the policy 103 and alter the audio input signal 109 to generate the audio output signal that complies with the rule(s) of the policy 103.

At step 212, an audible signal is generated by the peripheral audio accessory. In an example implementation, the speaker 118 of the peripheral audio accessory 101 is used to generate the audible signal 122 based at least in part on the audio output signal generated by the processor 116 in compliance with the policy 103.

In an example embodiment, the rule(s) define the volume control 214. For example, the rule(s) can define a maximum volume threshold, and the processor 116 can be configured so that it enforces the rule(s) by limiting the volume of the audio output signal generated by the processor 116 to be less than or equal to the maximum volume threshold. In an example embodiment, the rule(s) are configured to truncate, or "chop off", peaks of the audio input signal to reduce the maximum amplitude of the audio input signal, and the processor 116 is configured to generate an audio output signal based on the truncated audio input signal. In another example embodiment, the rule(s) include equalization ("EQ") parameters, and the processor 116 is configured to apply the EQ parameters to the audio input signal to limit (e.g., prevent) audio quality degradation of the audio output signal while limiting the volume of the audio output signal.

In another example embodiment, the rule(s) define a feature ON/OFF control, and the feature ON/OFF control can be used to control the operation of features included in the peripheral audio accessory 101. For example, the feature ON/OFF control can be configured to provide an ON/OFF toggle functionality. The features can be incorporated as software, firmware and/or hardware features. In an example embodiment, output from the microphone 128 can be excluded from the audio output signal generated by the processor 116 in compliance with the rule(s). The microphone 128 can be controlled by using the ON/OFF toggle functionality to regulate power being delivered to the microphone 128. Control of the microphone 128 can be incorporated to avoid situations in which the microphone 128 is inadvertently functional and captures undesirable speech by selectively disabling the functionality of the microphone 128.

In another example embodiment, the rule(s) include a content filter that defines selected content, and the processor 116 is configured to monitor the received audio input signal to determine whether the audio input signal includes the selected content. In such an embodiment, the processor 116 is configured to enforce the policy by filtering the audio content of the communication 104 to exclude the selected content. The selected content can include words, phrases, and/or subject matter, and the audio accessory may be configured to censor the selected content. The content filter can be tailored based on a selected audience. The selected content can be censored by muting or replacing the selected content with more desirable content. In an example embodiment, the content filter is applied in a real-time implementation, such as one using an artificial intelligence system (e.g., a Cortana®-based system), to perform real-time content filtering.

The audio input signal can be an analog audio input signal or a digital audio input signal. The content filter can be configured to operate on both analog and digital signals. In an example embodiment, the audio input signal is an analog audio input signal, and the processor 116 is configured to determine whether the analog audio input signal comprises a predefined signal pattern (e.g., by using keyword mapping). For example, the predefined signal pattern can correspond to the selected content, such as a predetermined word, phrase, or other sound, to be censored from the audio input signal.

In another example embodiment, the audio input signal is a digital audio input signal, and the processor 116 is configured to determine whether the digital audio input signal includes metadata that is related to the selected content to be censored from the audio input signal. The metadata can include offsets indicating the timing of profanity or mature content throughout the audio input signal and the duration of the selected content. Still further, the metadata can indicate the rating (e.g., predetermined rating) of portions, such as by utilizing Recording Industry Association of America (RIAA) ratings. In instances in which there is no metadata associated with the digital audio input signal, the processor 116 can convert the digital audio input signal into an analog audio input signal and apply the content filter as described above.

In another example embodiment, the rule(s) are directed to limiting a duration of audio output of the peripheral audio accessory 101. For example, the duration of audio output can be used to limit the duration for which the audio accessory is allowed to be used so that, for example, a parent can control the use of the audio accessory by a child.

As shown in FIG. 3, the method of flowchart 300 begins at step 302. In step 302, a policy is stored in a peripheral audio accessory. In an example implementation, the memory 114 of the peripheral audio accessory 101 receives and stores the policy 103.

At step 304, a communication is received by the peripheral audio accessory from a computing device. In an example implementation, the receiver 112 of the peripheral audio accessory 101 receives the communication 104 from the computer 106. The communication 104 may include an audio input signal 109, though the example embodiments are not limited in this respect.

At step 306, the communication is analyzed to determine whether the communication includes a command. In an example implementation, the communication 104 received by the peripheral audio accessory 101 is analyzed (e.g., by the processor 116) to determine whether the communication 104 includes the command. For example, the command can include a request to upgrade software, to alter the policy 103 stored in the peripheral audio accessory 101, or to alter the functionality of a feature of the peripheral audio accessory 101 (e.g., enabling or disabling the microphone 128). In an example embodiment, the communication 104 sent from the computer 106 includes a command to alter the policy 103 to change restrictions on a rule defining a content filter, such as to change the selected content designated to be censored. The communication 104 can include a feature ON/OFF control command. For example, the communication 104 can include a command to disable a feature. As an example, the command can be a signal that is used to trigger operation of the switch 130, which may be a software switch, a hardware switch, a fuse or an antifuse. For instance, the fuse can be a silicon fuse that is used to permanently switch functionality of a feature, such as the microphone 128, in response to the command. If the communication includes a command, flow continues to step 308. Otherwise, flow continues to step 318.

At step 308, the policy is enforced by the peripheral audio accessory, and in particular, an administrative rule of the policy is enforced. In an example implementation, the processor 116 enforces the policy 103 (e.g., based at least in part on a determination that the communication 104 includes a command). In an example embodiment, the policy 103 includes an administrative rule, and the processor 116 determines whether the administrative rule is applicable to the command. The administrative rule can define an authentication protocol, for example.

At step 310, a determination is made whether the computing device is successfully authenticated. In an example implementation, the processor 116 determines whether the computer 106 is successfully authenticated. For example, the processor 116 can execute the authentication protocol and determine whether the computer 106 possesses appropriate credentials in compliance with the authentication protocol for the peripheral audio accessory 101 to execute the command. If the computing device is successfully authenticated, flow continues to step 314. Otherwise, flow continues to step 312.

At step 312, the command is denied (e.g., based at least in part on the computing device not being successfully authenticated. In an example implementation, the processor 116 denies the command (i.e., does not execute the command).

At step 314, the command is executed (e.g., based at least in part on the computing device being successfully authenticated. In an example implementation, the processor 116 executes the command. For example, the software and/or firmware, including the policy 103, stored in the memory 114 of the peripheral audio accessory 101 can be uploaded or updated, and the peripheral audio accessory 101 can be reset, in accordance with the command. It should be appreciated that the policy 103 can be distributed to the peripheral audio accessory 101 through the computer 106 or another source device, or through a server, such as a cloud server. In another embodiment, the policy 103 can be loaded onto the peripheral audio accessory 101 during product registration.

At step 316, the communication is analyzed to determine whether the communication includes an audio input signal. In an example implementation, the processor 116 analyzes the communication 104 to determine whether the communication 104 includes an audio input signal 109. Step 316 can be performed after the command is denied at step 312. Alternatively, step 316 can be performed after the command is executed at step 314.

At step 318, the audio input signal is monitored by the peripheral audio accessory. In an example implementation, the processor 116 monitors the audio input signal 109 to determine whether the audio input signal 109 complies with an audio rule of the policy 103.

At step 320, the policy is enforced by the peripheral audio accessory, and in particular, an audio rule of the policy is enforced. In an example implementation, the processor 116 enforces the policy 103 that is stored locally in the memory 114 of the peripheral audio accessory 101. For example, the processor 116 may enforce the policy 103 by applying the audio rule of the policy 103 to the audio input signal 109.

At step 322, an audio output signal is generated by the peripheral audio accessory. In an example implementation, the processor 116 generates an audio output signal from the audio input signal 109. For example, the processor 116 may enforce the policy 103 and alter the audio input signal 109 to generate the audio output signal that complies with the audio rule of the policy 103.

Figure 4:
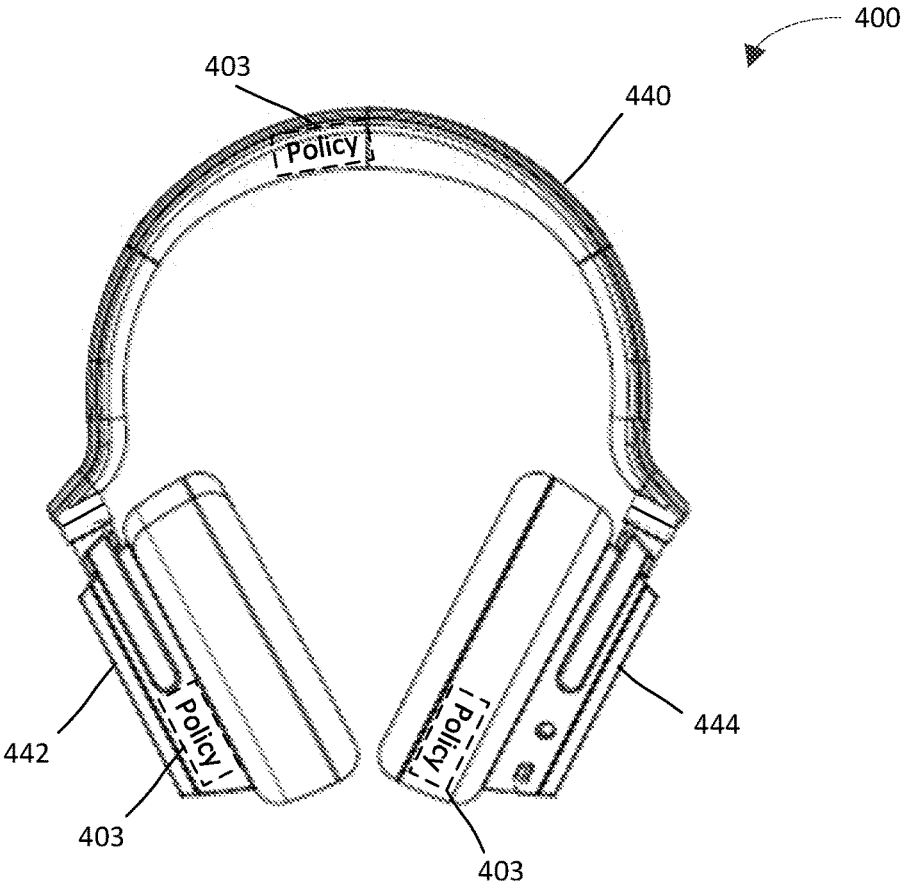
FIGS. 4 and 5 illustrate example peripheral audio accessories in accordance with embodiments.

FIG. 4 shows an audio accessory (e.g., peripheral audio accessory 101) constructed as a headphone device 400 in accordance with an embodiment. The headphone device 400 can be configured to connect to a separate source device using a wired or a wireless connection. The headphone device 400 comprises a headband 440, a first earcup 442 and a second earcup 444. The first earcup 442 and the second earcup 444 include speakers that generate an audible signal. The headband 440 and/or earcups 442 and 444 can be configured to house the components of the audio accessory such as a receiver, a memory, and one or more processors (e.g., receiver 112, memory 114, and processor 116). A policy 403 is stored on the headphone device 400 that includes at least one rule, and the rule is enforced by the processor included in the headphone device 400. The policy 403 can be stored in any portion of the headphone device 400, and a plurality of policies 403, having different rules, can be stored in the headphone device together or separately. In an example embodiment, the headphone device 400 can be used by a child, and a parent is able to control the headphone device 400, such as by setting the policy 403 stored in the headphone device 400 using a control device (e.g., computer 106). The parent can define the parameters of the policy 403 such as by defining a rule included in the policy 403 as previously described, such as a rule defining a content filter. In another example embodiment, the headphone device 400 comprises a plurality of policies 403, including a first policy stored in the first earcup 442 and a second policy stored in the second earcup 444, and the first and second policies include different rules that are directed to different users. As an example, the first policy can include rule(s) that apply to the use of the headphone device 400 by an adult, while the second policy includes rule(s) that apply to the use of the headphone device 400 by a child.

The headphone device 400 is illustrated having an on-ear construction, but it should be appreciated that the headphone device 400 can be constructed having an in-ear construction. For example, instead of having first and second earcups, the in-ear construction includes first and second earbuds and can be configured to connect to a separate source device using a wired or a wireless connection. The features described above with regard to the on-ear construction of the headphone device 400 apply equally to an in-ear construction. For example, a headphone device having an in-ear construction comprises components such as a receiver, a memory, and one or more processors (e.g., receiver 112, memory 114, and processor 116). The components can be incorporated into the first earbud and/or the second earbud, and/or any structure (such as a cable) extending between the first earbud and the second earbud. Additionally, the headphone device having the in-ear construction includes one or more policies, which can be stored in a memory incorporated into any portion of the headphone device. Still further, the headphone device having the in-ear construction can include a plurality of policies directed to different users and those policies can be stored together or separately.

Figure 5:
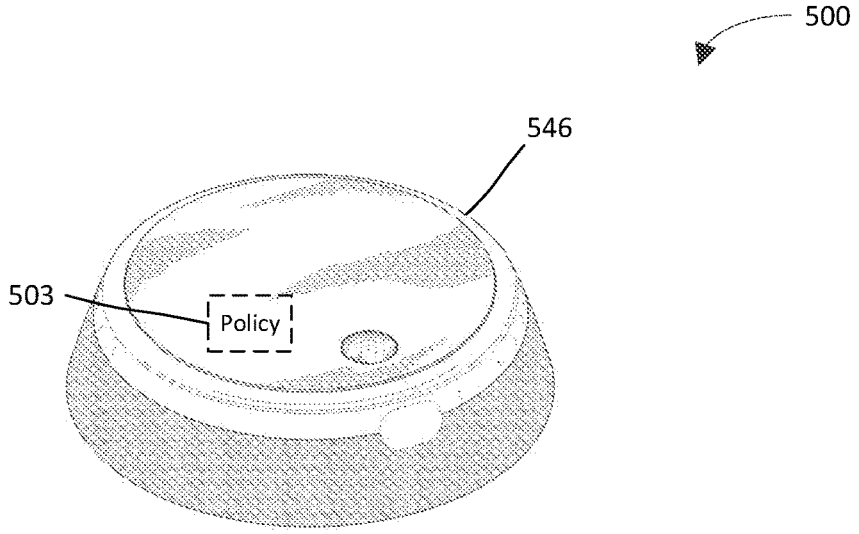

FIG. 5 shows an audio accessory (e.g., peripheral audio accessory 101) constructed as a portable speaker 500 in accordance with an embodiment. The portable speaker 500 comprises a housing 546 that stores a speaker and speaker circuitry (not shown). The housing 546 can be configured to house the components of the audio accessory such as a receiver, a memory, and one or more processors (e.g., receiver 112, memory 114, and processor 116). A policy 503 is stored on the portable speaker 500 that includes at least one rule, and the rule is enforced by the processor(s) included in the portable speaker 500. The processor(s) generate an audio output signal that is converted into an audible signal by the speaker. It should be appreciated that a control device can be used to load the policy 503 into the portable speaker 500. For example, the rule can correspond to an environment, or audience, that will be exposed to the audible signal generated by the portable speaker 500. In an example embodiment, the portable speaker 500 may be located in a place of business, and the policy 503 can be directed to limit the content and/or volume of an output audio signal produced by the portable speaker 500.

III. Further Discussion of Some Example Embodiments

A first example peripheral audio accessory comprises a receiver, a memory, and one or more processors. The receiver is configured to receive an audio input signal from a separate source device. The audio input signal is based at least in part on content processed by the separate source device. The peripheral audio accessory is dependent on the separate source device for providing the audio input signal. The memory is configured to store a policy that includes at least one rule. The one or more processors are coupled to the memory. The one or more processors are configured to monitor a received audio input signal to determine whether the received audio input signal complies with the at least one rule of the policy. The at least one rule defines at least one of a volume control, a feature ON/OFF control, or a content filter. The one or more processors are further configured to enforce the at least one rule of the policy. The one or more processors are further configured to generate an audio output signal based at least in part on the enforcement of the at least one rule.

In a first aspect of the first example peripheral audio accessory, the at least one rule defines the content filter, the received audio input signal comprises audio content, and the content filter defines selected content to be censored by the peripheral audio accessory.

In a first implementation of the first aspect of the first example peripheral audio accessory, the one or more processors are configured to monitor the received audio input signal to determine whether the received audio input signal includes the selected content, and to enforce the at least one rule of the policy by filtering the audio content of the received audio input signal to exclude the selected content.

In a second implementation of the first aspect of the first example peripheral audio accessory, the received audio input signal is an analog audio input signal, and the one or more processors are configured to monitor the analog audio input signal to determine whether the analog audio input signal comprises a predefined signal pattern. The predefined signal pattern defines at least one of a predetermined phrase or a predetermined word.

In a third implementation of the first aspect of the first example peripheral audio accessory, the received audio input signal is a digital audio input signal, and the one or more processors are configured to monitor the digital audio input signal to determine whether the digital audio input signal comprises metadata related to the selected content. The metadata defines at least one of a predetermined phrase, a predetermined word, or a predetermined rating.

In a second aspect of the first example peripheral audio accessory, the at least one rule defines the feature ON/OFF control, and the feature ON/OFF control is a microphone control that is configured to control the operation of a microphone of the audio accessory. The second aspect of the first example peripheral audio accessory can be implemented in combination with the first aspect of the first example peripheral audio accessory, though the example embodiments are not limited in this respect.

A second example peripheral audio accessory comprises a receiver, a memory, and one or more processors. The receiver is configured to receive a command from a separate source device and an audio input signal. The peripheral audio accessory is dependent on the separate source device for providing the audio input signal. The memory is configured to store a policy comprising at least one administrative rule and at least one audio rule. The one or more processors are coupled to the memory. The one or more processors are configured to monitor a received command to determine whether the received command complies with the at least one administrative rule of the policy. The one or more processors are further configured to monitor a received audio input signal to determine whether the received audio input signal complies with the at least one audio rule of the policy. The one or more processors are further configured to enforce the at least one administrative rule of the policy and the at least one audio rule of the policy. The one or more processors are further configured to generate an audio output signal based at least in part on the enforcement of the at least one audio rule.

In a first aspect of the second example peripheral audio accessory, the at least one audio rule defines a content filter, the received audio input signal comprises audio content, and the content filter defines selected content to be censored by the audio accessory.

In a first implementation of the first aspect of the second example peripheral audio accessory, the one or more processors are configured to monitor the received audio input signal to determine whether the received audio input signal includes the selected content, and the one or more processors are configured to enforce the audio policy by filtering the audio input signal to exclude the selected content.

In a second implementation of the first aspect of the second example peripheral audio accessory, the received audio input signal is an analog audio input signal.

In an example of the second implementation, the one or more processors are configured to monitor the analog audio input signal to determine whether the analog audio input signal comprises a predefined signal pattern.

In a third implementation of the first aspect of the second example peripheral audio accessory, the received audio input signal is a digital audio input signal.

In an example of the third implementation, the one or more processors are configured to monitor the digital audio input signal to determine whether the digital audio input signal comprises metadata related to the selected content.

In a second aspect of the second example peripheral audio accessory, the at least one administrative rule defines an authentication protocol, the separate source device is a control device that is configured to administratively control the peripheral audio accessory, and the one or more processors are configured to authenticate the control device based at least in part on the authentication protocol. The second aspect of the second example peripheral audio accessory can be implemented in combination with the first aspect of the second example peripheral audio accessory, though the example embodiments are not limited in this respect.

In a third aspect of the second example peripheral audio accessory, the at least one administrative rule comprises a software update rule. The third aspect of the second example peripheral audio accessory can be implemented in combination with the first and/or second aspect of the second example peripheral audio accessory, though the example embodiments are not limited in this respect.

In a fourth aspect of the second example peripheral audio accessory, the at least one audio rule defines at least one of a volume control, a feature ON/OFF control, or a content filter. The fourth aspect of the second example peripheral audio accessory can be implemented in combination with the first, second and/or third aspect of the second example peripheral audio accessory, though the example embodiments are not limited in this respect.

In a fifth aspect of the second example peripheral audio accessory, the at least one audio rule defines the feature ON/OFF control, and the feature ON/OFF control is a microphone control that is configured to control the operation of a microphone of the peripheral audio accessory. The fifth aspect of the second example peripheral audio accessory can be implemented in combination with the first, second, third and/or fourth aspect of the second example peripheral audio accessory, though the example embodiments are not limited in this respect.

A third example peripheral audio accessory comprises a receiver, a memory, one or more processors, and a speaker. The receiver is configured to receive an audio input signal from a separate source device. The audio input signal is based at least in part on content processed by the separate source device. The peripheral audio accessory is dependent on the separate source device for providing the audio input signal. The memory is configured to store a policy that includes at least one rule. The one or more processors are coupled to the memory. The one or more processors are configured to monitor a received audio input signal to determine whether the received audio input signal complies with the at least one rule of the policy. The at least one rule defines at least one of a volume control or a content filter. The one or more processors are further configured to enforce the at least one rule of the policy. The one or more processors are further configured to generate an audio output signal. The speaker is configured to generate an audible signal based at least in part on the audio output signal.

In a first aspect of the third example peripheral audio accessory, the speaker is configured as a headphone.

In a second aspect of the third example peripheral audio accessory, the at least one rule defines a content filter, and the received audio input signal is a digital audio input signal that comprises audio content. The one or more processors are configured to monitor the digital audio input signal to determine whether the digital audio input signal comprises metadata related to selected content, and the metadata defines at least one of a predetermined phrase, a predetermined word, or a predetermined rating. The content filter defines the selected content to be censored by the peripheral audio accessory based at least in part on the metadata. The second aspect of the third example peripheral audio accessory can be implemented in combination with the first aspect of the third example peripheral audio accessory, though the example embodiments are not limited in this respect.

An example method of enforcing a policy using a peripheral audio accessory comprises receiving an audio input signal by the peripheral audio accessory, storing the policy in a memory of the peripheral audio accessory, monitoring the received audio input signal, enforcing at least one rule of the policy, and generating an audio output signal. The audio input signal is received by the peripheral audio accessory from a separate source device and based at least in part on content processed by the separate source device. The peripheral audio accessory is dependent on the separate source device for providing the audio input signal. The policy includes the at least one rule. The received audio input signal is monitored by one or more processors of the peripheral audio accessory to determine whether the received audio input signal complies with the at least one rule of the policy. The at least one rule defines at least one of a volume control, a feature ON/OFF control, or a content filter. The at least one rule of the policy is enforced by the one or more processors of the peripheral audio accessory. The audio output signal is generated by the one or more processors of the peripheral audio accessory based at least in part on the enforcement of the at least one rule.

In a first aspect of the example method, the at least one rule defines the content filter, the received audio input signal comprises audio content, and the content filter defines selected content to be censored by the peripheral audio accessory.

In a first implementation of the first aspect of the example method, monitoring the received audio input signal comprises determining whether the received audio input signal includes the selected content, and enforcing the at least one rule of the policy comprises filtering the audio content of the received audio input signal to exclude the selected content.

In a second implementation of the first aspect of the example method, the received audio input signal is an analog audio input signal. Monitoring the analog audio input signal comprises determining whether the analog audio input signal comprises a predefined signal pattern and the predefined signal pattern defines at least one of a predetermined phrase or a predetermined word.

In a third implementation of the first aspect of the example method, the received audio input signal is a digital audio input signal. Monitoring the digital audio input signal comprises determining whether the digital audio input signal comprises metadata related to the selected content and the metadata defines at least one of a predetermined phrase, a predetermined word, or a predetermined rating.

In a second aspect of the example method, the at least one rule defines the feature ON/OFF control, and the feature ON/OFF control is a microphone control that is configured to control the operation of a microphone of the peripheral audio accessory. The second aspect of the example method can be implemented in combination with the first aspect of the example method, though the example methods are not limited in this respect.

IV. Conclusion

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

What is claimed is:

1. A peripheral audio accessory, comprising:

a receiver configured to receive an audio input signal from a separate source device, the audio input signal based at least in part on content processed by the separate source device, wherein the peripheral audio accessory is dependent on the separate source device for providing the audio input signal;

a memory configured to store a policy that includes at least one rule; and one or more processors coupled to the memory, the one or more processors configured to:

monitor a received audio input signal to determine whether the received audio input signal complies with the at least one rule of the policy, wherein the at least one rule defines a microphone control that is configured to control operation of a microphone of the peripheral audio accessory;

enforce the at least one rule of the policy; and generate an audio output signal based at least in part on the enforcement of the at least one rule.

2. The peripheral audio accessory of claim 1, wherein the at least one rule defines a content filter, wherein the received audio input signal comprises audio content, and wherein the content filter defines selected content to be censored by the peripheral audio accessory.

3. The peripheral audio accessory of claim 2, wherein the one or more processors are configured to monitor the received audio input signal to determine whether the received audio input signal includes the selected content, and wherein the one or more processors are configured to enforce the at least one rule of the policy by filtering the audio content of the received audio input signal to exclude the selected content.

4. The peripheral audio accessory of claim 2, wherein the received audio input signal is an analog audio input signal, wherein the one or more processors are configured to monitor the analog audio input signal to determine whether the analog audio input signal comprises a predefined signal pattern, and wherein the predefined signal pattern defines a predetermined phrase.

5. The peripheral audio accessory of claim 2, wherein the received audio input signal is a digital audio input signal, wherein the one or more processors are configured to monitor the digital audio input signal to determine whether the digital audio input signal comprises metadata related to the selected content, and wherein the metadata defines a predetermined phrase.

6. The peripheral audio accessory of claim 2, wherein the received audio input signal is a digital audio input signal, wherein the one or more processors are configured to monitor the digital audio input signal to determine whether the digital audio input signal comprises metadata related to the selected content, and wherein the metadata defines a predetermined rating.

7. The peripheral audio accessory of claim 1, wherein the at least one rule defines a volume control.

8. A peripheral audio accessory, comprising:

a receiver configured to receive an audio input signal from a separate source device, the audio input signal based at least in part on content processed by the separate source device, wherein the peripheral audio accessory is dependent on the separate source device for providing the audio input signal;

a memory configured to store a policy that includes at least one rule;

one or more processors coupled to the memory, the one or more processors configured to:

monitor a received digital audio input signal that comprises audio content to determine whether the received digital audio input signal complies with the at least one rule of the policy by determining whether the digital audio input signal comprises metadata related to selected content, wherein the metadata defines at least one of a redetermined phrase or a predetermined rating, wherein the at least one rule defines a content filter, wherein the content filter defines the selected content to be censored by the peripheral audio accessory based at least in part on the metadata;

enforce the at least one rule of the policy; and generate an audio output signal; and a speaker configured to generate an audible signal based at least in part on the audio output signal.

9. The peripheral audio accessory of claim 8, wherein the speaker is configured as a headphone.

10. The peripheral audio accessory of claim 8, wherein the metadata defines the predetermined phrase.

11. The peripheral audio accessory of claim 8, wherein the metadata defines the predetermined rating.

12. The peripheral audio accessory of claim 8, wherein the selected content is censored by replacing the selected content with other content.

13. A method of enforcing a policy using a peripheral audio accessory, the method comprising:

receiving an audio input signal by the peripheral audio accessory, which is dependent on a separate source device for providing the audio input signal, from the separate source device, wherein the audio input signal is based at least in part on content processed by the separate source device;

storing the policy that includes at least one rule in a memory of the peripheral audio accessory;

monitoring the received audio input signal by one or more processors of the peripheral audio accessory to determine whether the received audio input signal complies with the at least one rule of the policy, wherein the at least one rule defines a microphone control that is configured to control operation of a microphone of the peripheral audio accessory;

enforcing the at least one rule of the policy by the one or more processors of the peripheral audio accessory; and generating an audio output signal by the one or more processors of the peripheral audio accessory based at least in part on the enforcement of the at least one rule.

14. The method of claim 13, wherein the received audio input signal comprises audio content; and wherein the at least one rule defines a content filter such that the content filter defines selected content to be censored by the peripheral audio accessory.

15. The method of claim 14, wherein monitoring the received audio input signal comprises:

determining whether the received audio input signal includes the selected content; and wherein enforcing the at least one rule of the policy comprises:

filtering the audio content of the received audio input signal to exclude the selected content.

16. The method of claim 14, wherein the received audio input signal is an analog audio input signal; and wherein monitoring the received audio input signal comprises:

determining whether the analog audio input signal comprises a predefined signal pattern that defines a predetermined phrase.

17. The method of claim 14, wherein the received audio input signal is a digital audio input signal;

wherein monitoring the received audio input signal comprises:

determining whether the digital audio input signal comprises metadata related to the selected content; and wherein the metadata defines at least one of a predetermined phrase or a predetermined rating.

18. The method of claim 13, wherein the at least one rule defines a volume control.

19. The method of claim 13, wherein the microphone control is a feature ON/OFF control.

20. The method of claim 13, wherein the at least one rule defines at least one of a volume control or a content filter; and wherein the method further comprises:

generating an audible signal by a speaker of the peripheral audio accessory based at least in part on the audio output signal.

* * * * *